US007162966B2

(12) United States Patent
Durville et al.

(10) Patent No.: US 7,162,966 B2
(45) Date of Patent: Jan. 16, 2007

(54) SEWING OR EMBROIDERY MACHINE

(75) Inventors: Gerard Durville, Gipf-Oberfrick (CH); Roland Beer, Weinfelden (CH); Beda Steinacher, Baden (CH); Michael Berger, Constance (DE)

(73) Assignee: itz Gegauf Aktiengesellschaft RNINA-Nahmaschinenfabrik, Steckborn (CH)

( * ) Notice: Subject to any disclaimer, the term of this patent is extended or adjusted under 35 U.S.C. 154(b) by 0 days.

(21) Appl. No.: 11/374,338

(22) Filed: Mar. 13, 2006

(65) Prior Publication Data

US 2006/0213412 A1 Sep. 28, 2006

(30) Foreign Application Priority Data

Mar. 11, 2005 (CH) ..... 424/05

(51) Int. Cl.
*D05B 59/02* (2006.01)
*D05B 57/08* (2006.01)

(52) U.S. Cl. ..... 112/475.01; 112/278

(58) Field of Classification Search ..... 112/475.02, 112/475.01, 273, 278, 279, 186, 182, 190, 112/180

See application file for complete search history.

(56) References Cited

U.S. PATENT DOCUMENTS

| | | | | |
|---|---|---|---|---|
| 4,805,544 | A * | 2/1989 | Dobner et al. | 112/278 |
| 4,934,292 | A * | 6/1990 | Mardix et al. | 112/273 |
| 5,161,475 | A * | 11/1992 | Tawara et al. | 112/278 |
| 6,810,824 | B1 * | 11/2004 | Durville | 112/278 |
| 6,996,451 | B1 * | 2/2006 | Asai et al. | 700/136 |

FOREIGN PATENT DOCUMENTS

| | | |
|---|---|---|
| DE | 34 47 138 | 7/1986 |
| EP | 1 375 725 | 3/2003 |

* cited by examiner

*Primary Examiner*—Ismael Izaguirre
(74) *Attorney, Agent, or Firm*—Volpe and Koening, P.C.

(57) ABSTRACT

To determine the thread supply on a lower-thread bobbin (17), holes (19) are arranged in the shape of a spiral in a flange (21) of the bobbin. Light from a light source (35), which is directed towards the flange (21), is reflected only by those holes (19), behind which there is no longer any thread, so that the light beams (36) reach the rear flange (22) and can be reflected therefrom and received by the light receiver (39).

10 Claims, 6 Drawing Sheets

SEWING OR EMBROIDERY MACHINE

BACKGROUND

The subject matter of the invention is a sewing or embroidery machine, and in particular to sewing or embroidery machines with sensors associated with the lower thread supply.

When sewing and embroidering with a sewing machine, it is known to loop two threads, the upper thread and the lower thread, with each other. The upper thread, also called the needle thread, is supplied from a spool, which is arranged on or near the sewing machine and which is freely accessible and exchangeable. Its size can be selected essentially freely. The lower thread is wound on a lower-thread bobbin, which is placed in the interior of the sewing machine hook, which is supported and driven so that it can rotate, with the bobbin being supported in the hook so that it can rotate freely. Consequently, the diameter of the hook also determines the maximum size or diameter of the lower-thread bobbin lying therein. The quantity of lower thread wound onto the lower-thread bobbin, i.e., the lower-thread supply, is always smaller by a multiple in comparison with the upper-thread supply on the spool arranged outside of the machine housing. In addition, the lower-thread bobbin cannot be seen from the outside while sewing, because it is located inside the hook housing and the latter is located inside the housing of the sewing machine. For this reason, monitoring the current lower-thread supply and the end of the thread is difficult during the embroidery or sewing process and is associated with technical expense.

From the state of the art, measurement devices are already known, with which attempts have been made to determine the remaining quantity of lower thread on the lower-thread bobbin as exactly as possible and to stop the sewing machine before the end of the lower-thread is pulled out through the material being sewn by the upper-thread and before stitches are sewn, which are consequently not held by a lower-thread on the bottom side of the material being sewn.

From DE-C2 34 47 138, such a device is known on a two-step lock-stitch sewing machine, with which the winding of the lower-thread bobbin and the sewing operation can be monitored. There are bore holes in the lower-thread bobbin in the front flange at a constant radial distance to the bobbin rotational axis, i.e., on a common reference circle. Light beams from a light source are guided through the thread space of the bobbin between the circular ring-shaped flanges of the bobbin body to the rear flange and reflected from the rear flange for a low thread supply and detected by a light beam receiver. This device can determine a remaining thread quantity when its diameter on the bobbin becomes smaller than the diameter, at which the bore holes are located. In addition, through the intermittent reflection created by the spaced bore holes, it can be determined whether the bobbin is stationary (thread break or end of thread) or whether the bobbin is still rotating (driven by the thread pull). Thus, this device can determine when the thread quantity falls below a minimum value and the rotational state of the bobbin. However, it is not possible to determine the decrease in thread quantity per unit of time on the bobbin and consequently it is also not possible to calculate from this the expected time to the end of the thread. There is also no way to determine the thread thickness.

SUMMARY

One objective of the present invention is to create a sewing or embroidery machine with a device for determining the current supply of lower-thread on the lower-thread bobbin, to calculate the thread thickness and therewith the remaining thread length.

This objective is met by a sewing or embroidery machine according to the invention.

Advantageous configurations of the invention are described below and recited in the claims.

With the sewing or embroidery machine according to the invention, the remaining thread length on the lower-thread bobbin and the thread thickness can be calculated with simple means and high reliability. The end of the thread and the thread use per unit of time or per stitch can also be calculated very precisely from the decrease of the thread supply measured per unit of time. The device (bobbin body and measurement electronics) is economical and can be installed with minimal space requirements.

Another advantage provided from the knowledge of the thread thickness, namely the ability to adapt the upper-thread tension and if need be other sewing parameters, such as the advance of the material being sewn by the feed dog or the stitching frequency of the needle, automatically to the appropriate parameters of the lower-thread.

BRIEF DESCRIPTION OF THE DRAWINGS

With reference to an illustrated embodiment, the invention is explained in more detail. In the drawings.

DETAILED DESCRIPTION OF THE PREFERRED EMBODIMENTS

Figure 1:
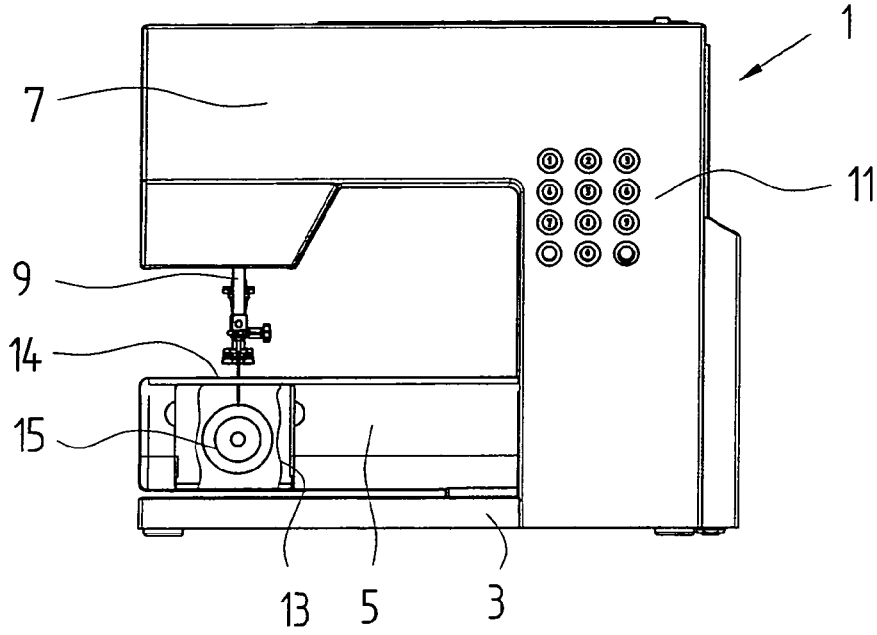
FIG. 1 is a schematic view of the side view of a sewing machine (with the lower arm partially cut away)
Figure 2:
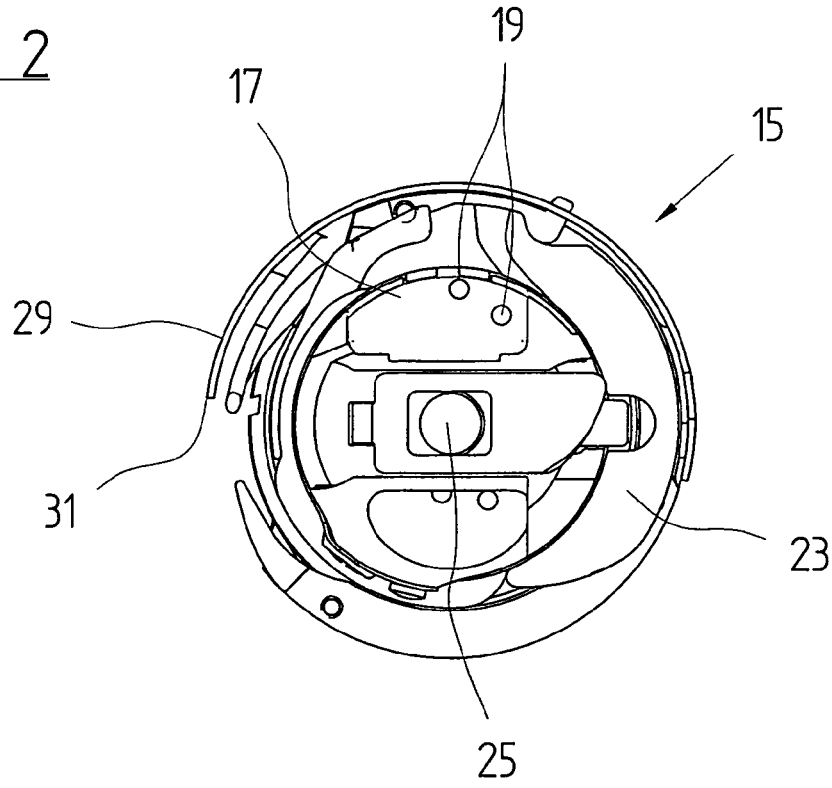
FIG. 2 is an enlarged end view of the hook with inserted lower-thread bobbin.

The household sewing machine 1 shown in FIG. 1 comprises a flat bed 3, a lower or free arm 5, an upper arm 7 with a needle bar 9, as well as the machine housing 11, in which the driving elements necessary for the sewing process are housed. A cover 13 arranged on the user side is partially cut away on the front end of the lower arm 5, in order to make visible the position of the hook 15 rotating about a horizontal axis. Obviously the rotational axis of the hook 15 could also be arranged vertically and the cover 13 could lie in the plane of the needle plate 14 on the free arm 5. A lower-thread bobbin body, in short a lower-thread bobbin 17, with a plurality of holes 19 in the front flange 21 is inserted in the hook 15. The lower-thread bobbin 17 is visible in FIG. 2 only in sections. The remaining parts of the commercially available hook 15, like the hook body 23, the drive shaft 25, and the pinion sitting on the drive shaft 25, as well as the thread catch sheet 29 with the tip 31, are not described or shown in more detail.

Figure 3:
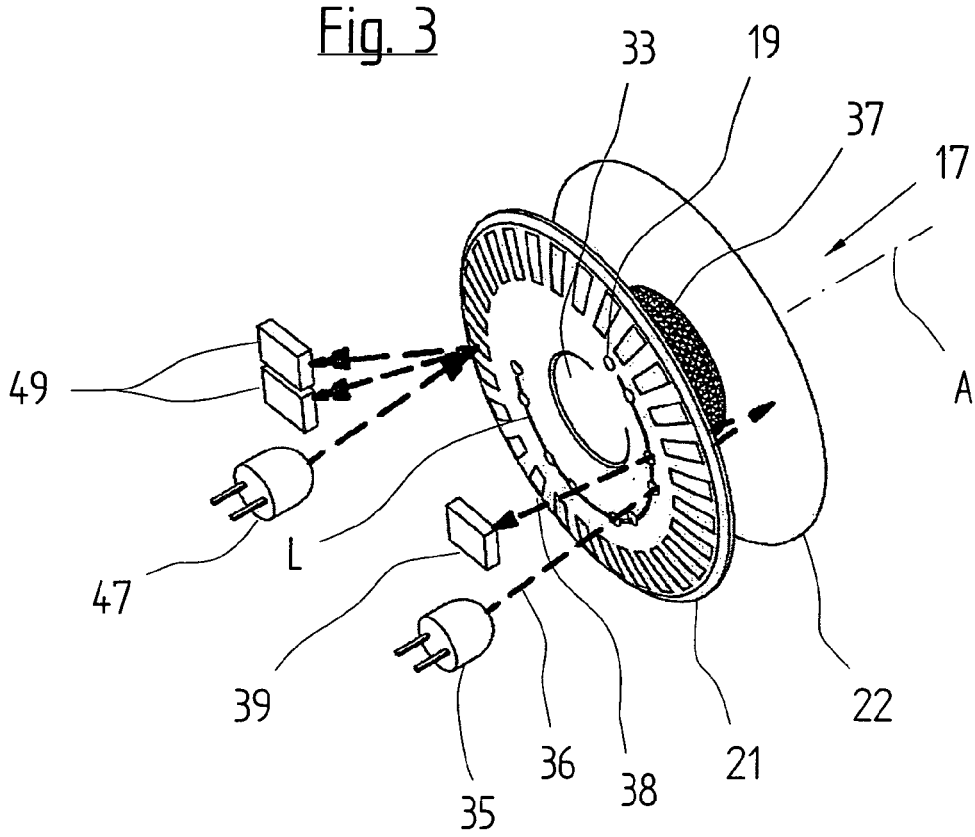
FIG. 3 is a perspective view of the lower-thread bobbin, as well as the sensors.

In FIG. 3, for reasons of better clarity, the hook 15 with the hook body 23 and also the attachment means for the sensors 35, 39 are left out and only the lower-thread bobbin 17 and the light-beam paths from and to the sensors are shown. In this Figure, the bobbin spindle or core 33, on whose ends the two circular ring-shaped flanges 21 and 22 are fixed, is also visible.

The holes 19 are formed in the front flange 21 lying closer to a light source 35. In the first embodiment, they lie on an imaginary line L with a spiral-like profile relative to the bobbin axis A. Each adjacent pair of holes 19 can also lie on a common reference circle (cf. FIGS. 5, 8–11). The size, shape, and number of holes 19 can be selected freely within suitable ranges for the functionality of the invention. The lower-thread bobbin 17 can be manufactured from metal or plastic. Preferably, in connection with the present invention it is produced from metal. The holes 19 arranged according to the invention could also be formed in the rear flange 22. These are preferably not arranged congruent with those in the front flange 21. This has the advantage that during winding, i.e., filling the bobbin with thread, attention does not have to be given to the winding direction.

Figure 4:
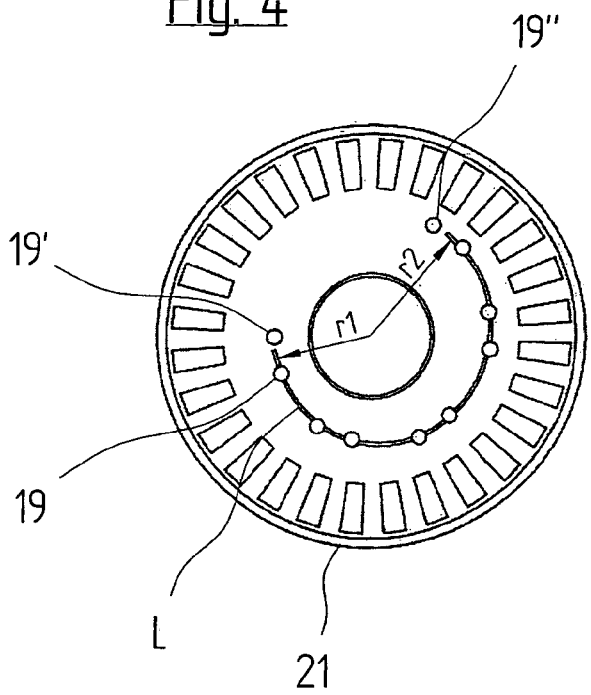
FIG. 4 is a top view (axial) of the front flange of the lower-thread bobbin.

The holes 19 shown round, for example, in the figures are offset radially such that the hole or hole pair 19' arranged closest to the bobbin rotational axis A lies close to the surface of the bobbin spindle 33 (r1) and the outermost hole or hole pair 19" lies close to the peripheral edge 21' of the flange 21 (r2). The holes 19', 19, 19" can extend over an angle of 360° or, as shown in the example according to FIG. 4, over an angle of about 270°.

The holes 19 can also be arranged, in the extreme cases, as an extended spiral—or on a chord (not shown).

Figure 5:
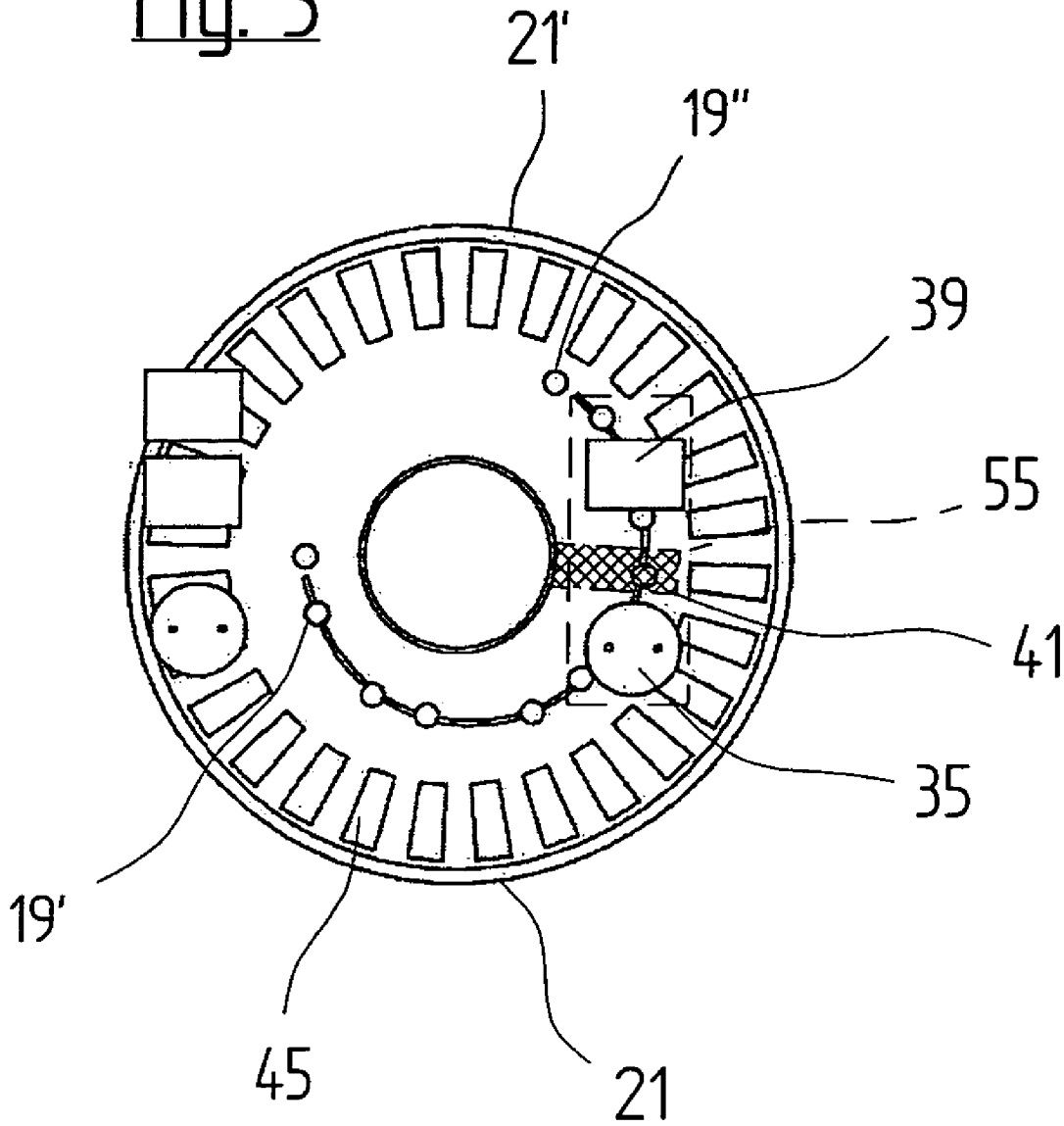
FIG. 5 is a top view (axial) of the front flange of the lower-thread bobbin and the sensors.

A sensor in the form of a light source 35 for visible or invisible light, for example, an LED, is attached at an axial distance to the surface of the front flange 21 of the bobbin 17 in the examples. With this light source, a light beam, which can be a pulsed light beam 36, can be directed with its axis parallel to the bobbin or, as shown, at an acute angle to the front surface of the front flange 21 and—if the light beam 36 is incident on a hole 19—it is reflected by the rear flange 22 after passing through the empty bobbin space. A perforated, rear flange can also be used for reflection if the holes are offset relative to the holes in the front flange. If the rear flange 22 is provided with congruent holes 19, the light beam 36 can be reflected on a reflective surface arranged behind the bobbin 17 (surface not shown). The beam 38 reflected at an acute angle leaves the bobbin 17 according to the angle of incidence through the incident hole or through an adjacent hole 19. The beams 38 reflected at the surface of the rear flange 22 by a light receiver 39, e.g., a transistor, or, for a still present thread supply, beams are non-detectably reflected from the threads. Here, it is insignificant whether the reflection occurs directly as a beam or whether only scattered light falls on the light receiver 39 (FIGS. 3 and 5).

Figure 6:
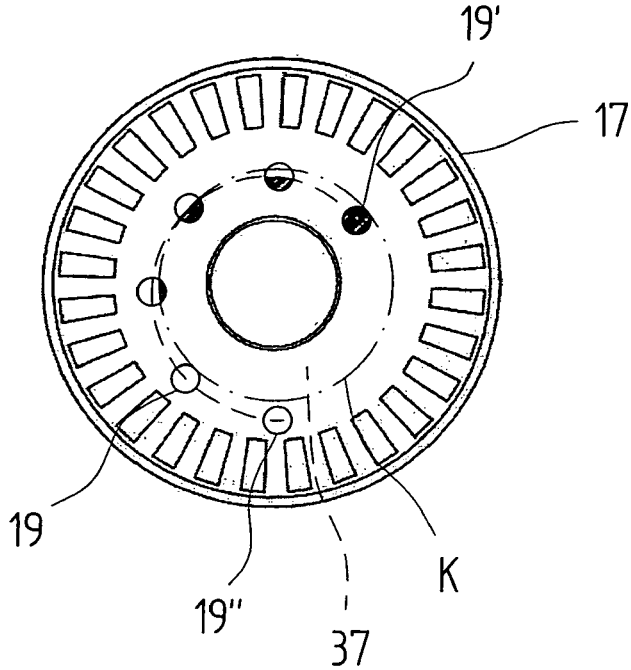
FIG. 6 is an axial top view of the lower-thread bobbin with completely and partially covered holes.

The circle K shown with broken lines in FIG. 6 represents the periphery of the current thread supply 37 on the lower-thread bobbin 17. The holes 19 that are filled (shown in black) are covered by the thread supply 37; the remaining holes 19 (shown as circular rings), which lie outside of the thread supply 37, are uncovered and light beams 36, 38 directed from the light source 35 against the lower-thread bobbin 17 can enter into the bobbin space and can be reflected from the surface of the rear flange 22 (see FIGS. 3 and 6). Light beams 36 intersecting one of the holes 19 lying in front of the thread supply 37 are not reflected. Beams reflected directly on the surface of the front flange 21 next to the holes 19 are not detected by the light receiver 39, because the reflected beams cannot intersect the light receiver 39; they pass by the light receiver 39.

Consequently, if the lower-thread bobbin 17 is completely filled with lower-thread and all of the holes 19 are covered from behind by thread, then there is no reflection that can be received by the light receiver 39. In addition, the surface of the front flange 21 can be non-reflective, for example, blackened, in order to prevent scattered light, which can cause errors in the measurement results. The more reflected beams fall on the light receiver 39 per rotation of the bobbin, the smaller is the thread supply on the lower-thread bobbin 17. Expressed differently: the greater the received light quantity, the smaller the thread supply.

Every two adjacent holes 19 can be arranged next to each other on the same reference circle. The light beam 36 emitted by the light source 35 is directed at an acute angle to the bobbin axis A onto the lower-thread bobbin 21 and, viewed in the rotational direction, can enter through the first hole 19 and, if it is reflected on the rear flange 22, emerge through the second hole 19. In this configuration of the invention, the surface of the first flange 21 can have a conventional configuration, i.e., it can also be reflective, as is typical for metal bobbins.

The light source 35 preferably emits its light not as a point as shown in FIG. 3 on the flange 21, but instead in the shape of a strip 41 lying radially to the bobbin rotational axis A as shown in FIG. 5. The light receiver 39 also has the shape of a strip accordingly, in order to be able to receive the reflected light beams emerging at a different distance from the axis A over the radial extent of the flanges 21 or 22.

Figure 7:
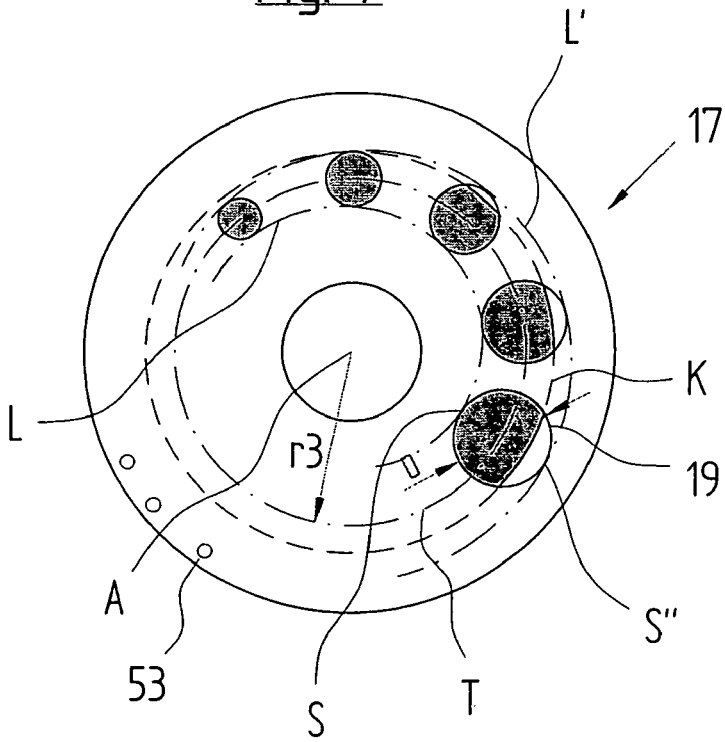
FIG. 7 is a view of another embodiment of the invention with different size holes, whose centers lie on a common concentric circle.
Figure 8:
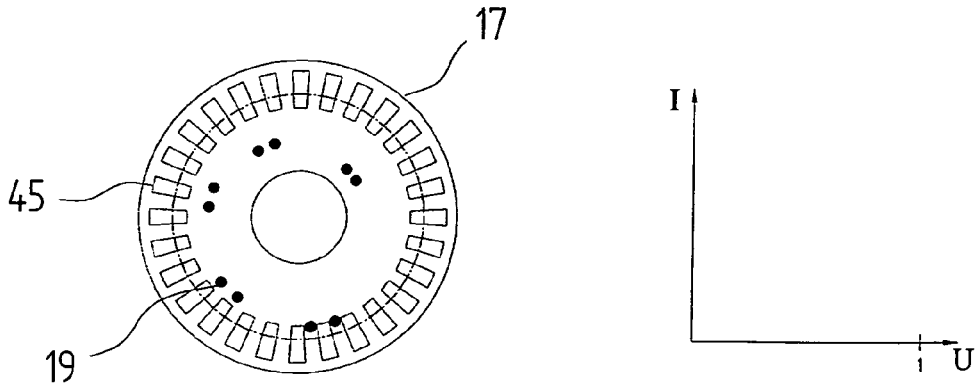
FIG. 8 is an axial top view of a full lower-thread bobbin, as well as the pulse/rotation diagram.

The axial view of the bobbin 17 in FIG. 7 shows, for example, five holes 19 with different diameters D, which are arranged on a concentric reference circle T with radius r3. The peaks S facing the rotational axis A of the bobbin 17, in turn, lie on a spiral, imaginary line L. Obviously, the outer peaks S' also lie on a spiral line and as the diameter of the thread supply decreases, one hole 19 after the hole becomes passable for the light beams in succession. If the periphery of the thread supply K is as shown in FIG. 7, then the cross sections of three of the five holes 19 are partially exposed. Two holes are still covered completely by the thread.

FIGS. 8–11 show the pulses that can be measured as a function of the level of the bobbin 17 per bobbin rotation. If the bobbin 17 is completely filled with thread, then no pulse can be measured, because none of the holes 19 are exposed.

Figure 9:
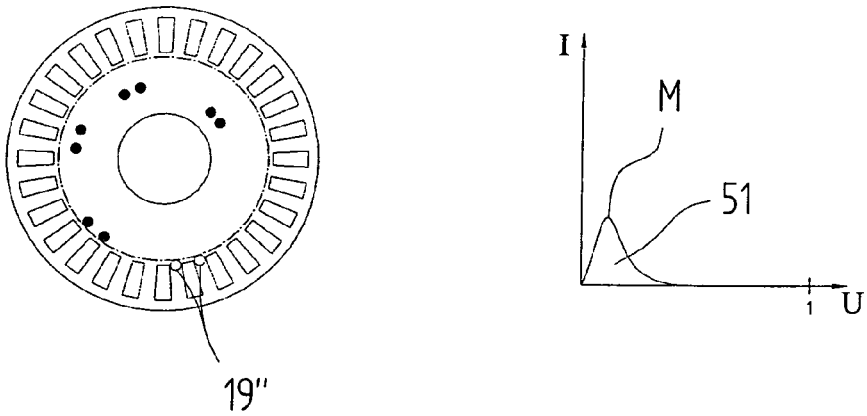
FIG. 9 is a top view of a bobbin with one pair of free holes and an axial top view of a not completely full lower-thread bobbin, as well as the pulse/rotation diagram.
Figure 10:
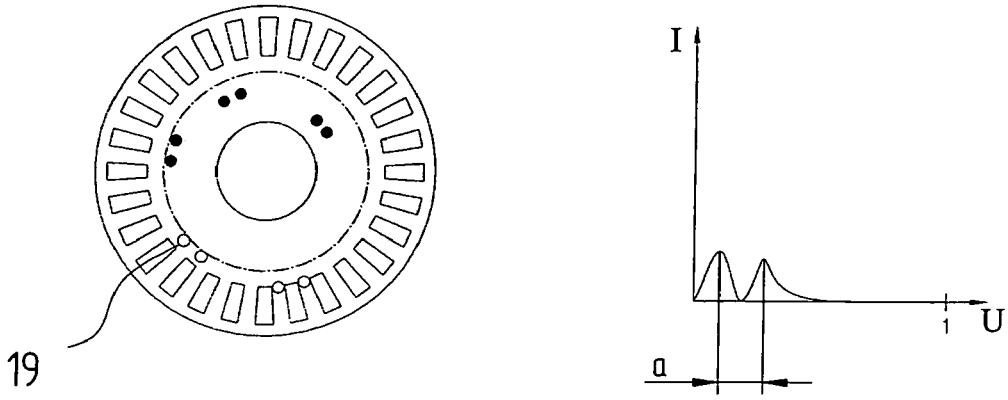
FIG. 10 is a top view of a bobbin with two pairs of free holes and an axial top view of a half-full lower-thread bobbin, as well as the pulse/rotation diagram.
Figure 11:
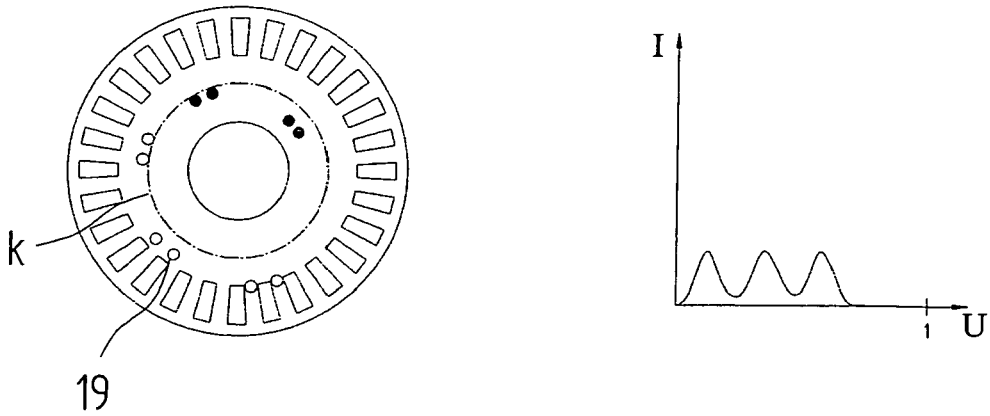
FIG. 11 is a top view of a bobbin with three pairs of free holes and an axial top view of a quarter-full lower-thread bobbin, as well as the pulse/rotation diagram.

The operating state of the bobbin (standstill, forwards or backwards movement) can be determined at this point using the marks 45 on the periphery of the flange 21 and the sensors 47, 49. In FIG. 9, the first hole pair 19" is completely exposed and for each bobbin rotation a pulse 51 is generated with a maximum M. For two exposed hole pairs 19 from FIG. 10, two pulses 51 per rotation of the bobbin 17 are already generated. Starting at this moment, the operating state of the bobbin 17 can also be determined just through the pulses 51 or the mutual distances a of the maximum values M, because the geometric position of the two hole pairs 19 is known. In FIG. 11, there are already three hole pairs 19 outside of the thread supply and the distance r of the holes from the rotational axis and the rpm of the course of the thread use and thus the time of the end of the thread can be calculated by the time elapsed between the first passage of light beams through the individual hole pairs 19.

As an alternative to the marks 45 formed on the periphery for measuring the operating state, through holes 53 can be formed outside of the periphery of the maximum fill state. Through these holes, light beams can also be reflected for a maximum fill level, with reference to which the operating state of the bobbin 17 can be calculated (cf. FIG. 7). Preferably, the distances of the bore holes 53 are not equal in order to be able to also determine the rotational direction of the bobbin 17.

The embodiments are preferably combined with a device as described in EP-A2-1 375 725. With the known device, the current operating state of the lower-thread spool 17 (rpm and rotational direction) can be measured. Marks or holes 45 are arranged in the shape of a ring on the surface of the front flange 21. The marks 45 preferably lie outside of the holes 19 necessary for the measurement of the thread supply. The rotational direction and the rotational speed of the bobbin 17 are determined with a light transmitter 47 and two receivers 49.

Evaluation electronics are connected to another sensor, which determines the rpm no of the main shaft or the drive motor of the sewing machine, in order to not incorrectly interpret a detected standstill of the lower-thread bobbin 17 during a stop in sewing (standstill of the sewing machine) as a break in the thread or as the end of the thread.

In addition to the current fill level of the lower-thread bobbin 17 (remaining thread quantity), the time to the end of the thread can also be calculated exactly from the measurement values obtained above. Namely, no reflected light beam appears on the receiver 39 per rotation of the lower-thread bobbin 17, that is, the thread supply is above the detectable region, i.e., the bobbin 17 is approximately full. The more reflections measured per rotation or the greater the received light quantity, the smaller is the supply. According to the examples, if five reflections are measured per rotation, then the time of the end of the thread is approaching because there is no thread behind any of the holes 19 for blocking reflection of the light beams. With the measurement values, namely the rpm of the lower-thread bobbin 17 and the decrease in the diameter of the thread package on the lower-thread bobbin 17 per unit of time, the thread thickness and thus the remaining thread quantity can be determined in meters. From the remaining thread quantity, the number of stitches or the length of the seam that can still be sewn with the remaining thread quantity can also be determined.

The knowledge of the thread thickness further permits the automatic adaptation of the upper-thread tension, with which the position of the knot of the upper-thread and lower-thread within the material to be sewn can be set.

Consequently, the measurement values also allow the thread use per unit of time or per stitch to be calculated. If the thread use per stitch is greater than a stored desired value, then either the knot between the upper-thread and lower-thread is too close to the surface of the material to be sewn or the ratio of material advance and stitch count does not correspond to the desired value. Consequently, if the thread use per stitch deviates from the desired value, either the material advance of the feed dog can be controlled and/or, if the feed dog is not engaged with the material to be sewn, the stitch count per unit of time can be increased or reduced to keep the stitch length constant.

For increasing the accuracy of the measurement data, instead of the pulses generated by a hole, the intensity, i.e., the percentage of cross-sectional surface area of the hole that has already been exposed can also be measured and included in the calculation. This means that not only the number of pulses per rotation of the bobbin, but also the pulse level of each hole is detected in each rotation.

In a preferred configuration of the invention, the light source 35 and the light receiver 39 are inserted into a common housing 55 one next to the other. The housing is set on the cover 13, which is connected in an articulated way to the lower arm 5 of the sewing machine (cf. FIG. 5). This arrangement allows these elements to be mounted without additional holding devices and thus also without other costs to the existing parts (i.e., on the cover 13) of the sewing machine 1 and permits access to the lower-thread bobbin 17 and to these elements when the cover 13 is opened. Also, lint can easily be cleaned from the lenses set preferably in front of the light source 35 and the light receiver 39.

The light sources and light receiver can also be arranged behind the bobbin 17 (for a vertical bobbin axis under the bobbin).

The light sources can also be arranged in front and the light receiver behind the bobbin 17. The light passes through both bobbin flanges without reflection or it is interrupted when the thread supply blocks the path.

LEGEND

1 Sewing machine
3 Flat bed
5 Free arm
7 Upper arm
9 Needle bar
11 Machine housing
13 Cover
14 Needle plate
15 Hook
17 Lower-thread bobbin
19 Holes
21 Front flange
22 Rear flange
23 Hook body
25 Drive shaft
29 Catch thread sheet
31 Tip
33 Bobbin spindle
35 Light source
37 Thread supply
38 Reflected beams
39 Light receiver
41 Strip (FIG. 5)
43 Lens—not shown
45 Marks
47 Light transmitter
49 Receiver
51 Pulse
53 Hole
55 Housing

The invention claimed is:

1. Sewing or embroidery machine (1), comprising a hook (15) that can be driven by a drive motor and with a lower-thread bobbin (17) supported rotatably in the hook (15) for holding a lower-thread supply (37), the bobbin having a spindle and annular flanges (21, 22) set on ends of the spindle, at least one of the flanges (21) is perforated with a plurality of holes (19), and a light source (35) arranged axially in front of or behind the lower-thread bobbin (17), a light receiver (39) arranged in front of or behind the lower-thread bobbin (17) for receiving light beams emitted by the light source (35), a calculating and control unit for processing received signals supplied by the light receiver (39), wherein radially outer peaks (S') of the holes (19) in at least one of the flanges (21) of the lower-thread bobbin (17) have different distances from a rotational axis (A) of the lower-thread bobbin (17); wherein centers of the holes (19) or the outer peaks (S") of the holes (19) are arranged along a line (L') which extends in a spiral relative to the rotational axis (A) of the bobbin (17).

2. Sewing or embroidery machine (1), comprising a hook (15) that can be driven by a drive motor and with a lower-thread bobbin (17) supported rotatably in the hook (15) for holding a lower-thread supply (37), the bobbin having a spindle and annular flanges (21, 22) set on ends of the spindle, at least one of the flanges (21) is perforated with a plurality of holes (19) and a light source (35) arranged axially in front of or behind the lower-thread bobbin (17), a light receiver (39) arranged in front of or behind the lower-thread bobbin (17) for receiving light beams emitted by the light source (35), a calculating and control unit for processing received signals supplied by the light receiver (39), wherein radially outer peaks (S') of at least three of the holes (19) are located different distances from a rotational axis (A) of the lower-thread bobbin (17); and the holes (19) are arranged on a chord.

3. Sewing or embroidery machine according to claim 1, wherein adjacent pairs of the holes (19) are arranged on common reference circles.

4. Sewing or embroidery machine according to claim 1, wherein the light beams (36) of the light source (35) are directed parallel to the rotational axis (A) towards the lower-thread bobbin (17).

5. Sewing or embroidery machine according to claim 1, wherein the light beams (36) of the light source (35) are directed at an acute angle to the rotational axis (A) towards the lower-thread bobbin (17).

6. Sewing or embroidery machine according to claim 1, wherein the holes (19) have different diameters (D) and are arranged on a common reference circle (T).

7. Sewing or embroidery machine according to claim 1, wherein all of the holes (19) have an equal diameter.

8. A method for calculating a remaining thread quantity in a sewing or embroidery machine lower thread bobbin, comprising:

providing a sewing or embroidery machine (1), having a hook (15) that can be driven by a drive motor and with a lower-thread bobbin (17) supported rotatably in the hook (15) for holding a lower-thread supply (37), the bobbin having a spindle and annular flanges (21, 22) set on ends of the spindle, at least one of the flanges (21) is perforated with a plurality of holes (19), and a light source (35) arranged axially in front of or behind the lower-thread bobbin (17), a light receiver (39) arranged in front of or behind the lower-thread bobbin (17) for receiving light beams emitted by the light source (35), a calculating and control unit for processing received signals supplied by the light receiver (39), wherein radially outer peaks (S') of the holes (19) in at least one of the flanges (21) of the lower-thread bobbin (17) are arranged along a line (L') which extends in a spiral relative to the rotational axis (A) of the bobbin (17);

emitting light toward the bobbin;

detecting reflected light from the bobbin that passes through the holes that are not covered by lower bobbin thread wound on the bobbin, and is reflected back to the light receiver; and calculating a remaining quantity of the lower bobbin thread based using the calculating and control unit using a signal generated by the light detector based on the reflected light.

9. The method of claim 8, further comprising calculating at least one of a thickness of the thread, a thread use per unit of time, or thread use per stitch.

10. A method for calculating a remaining thread quantity in a sewing or embroidery machine lower thread bobbin, comprising:

providing a sewing or embroidery machine (1), having a hook (15) that can be driven by a drive motor and with a lower-thread bobbin (17) supported rotatably in the hook (15) for holding a lower-thread supply (37), the bobbin having a spindle and annular flanges (21, 22) set on ends of the spindle, at least one of the flanges (21) is perforated with a plurality of holes (19), and a light source (35) arranged axially in front of or behind the lower-thread bobbin (17), a light receiver (39) arranged in front of or behind the lower-thread bobbin (17) for receiving light beams emitted by the light source (35), a calculating and control unit for processing received signals supplied by the light receiver (39), wherein radially outer peaks (S') of at least three of the holes (19) in at least one of the flanges (21) of the lower-thread bobbin (17) have different distances from a rotational axis (A) of the lower-thread bobbin (17), and the holes (19) are arranged on a chord;

emitting light toward the bobbin;

detecting reflected light from the bobbin that passes through the holes that are not covered by lower bobbin thread wound on the bobbin, and is reflected back to the light receiver; and calculating a remaining quantity of the lower bobbin thread based using the calculating and control unit using a signal generated by the light detector based on the reflected light.

* * * * *